United States Patent [19]

Gnoinski

[11] Patent Number: 4,978,026

[45] Date of Patent: Dec. 18, 1990

[54] ROTATABLE SEAL

[75] Inventor: Richard Gnoinski, North Arlington, N.J.

[73] Assignee: E. J. Brooks Co., Newark, N.J.

[21] Appl. No.: 424,892

[22] Filed: Oct. 20, 1989

[51] Int. Cl.[5] ..... B65D 53/00

[52] U.S. Cl. ..... 220/214; 220/315; 292/307 R; 292/325

[58] Field of Search ..... 220/214, 315; 292/307 R, 325

[56] References Cited

U.S. PATENT DOCUMENTS

| | | | |
|---|---|---|---|
| 421,951 | 2/1890 | MacCarthy | 292/307 R |
| 1,911,060 | 5/1933 | Clark | 292/307 R |
| 2,144,336 | 1/1939 | Katz | 292/307 R X |
| 3,612,339 | 10/1971 | Jorgensen | 220/315 |
| 4,396,113 | 8/1983 | Gail et al. | 220/214 X |

*Primary Examiner*—Gary E. Elkins
*Assistant Examiner*—Nova Stucker
*Attorney, Agent, or Firm*—Carella, Byrne, Bain, Gilfillan, Cecchi & Stewart

[57] ABSTRACT

A rotatable seal which includes two inter-fitted relatively rotatable members. A sealing wire is passed through a hasp and through aligned apertures in the members. Relative rotation of the members causes the sealing wire to be wrapped at least partially around one of the members. Relative axial displacement of the members causes the apertures to be mis-aligned and the seal to be locked.

9 Claims, 6 Drawing Sheets

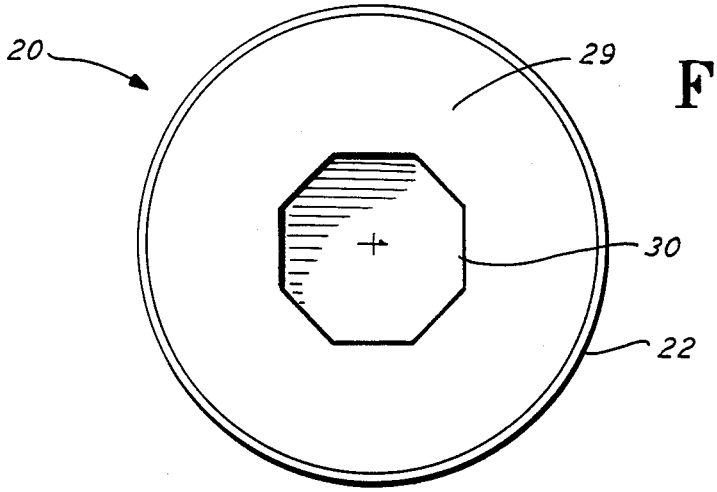
FIG. 4
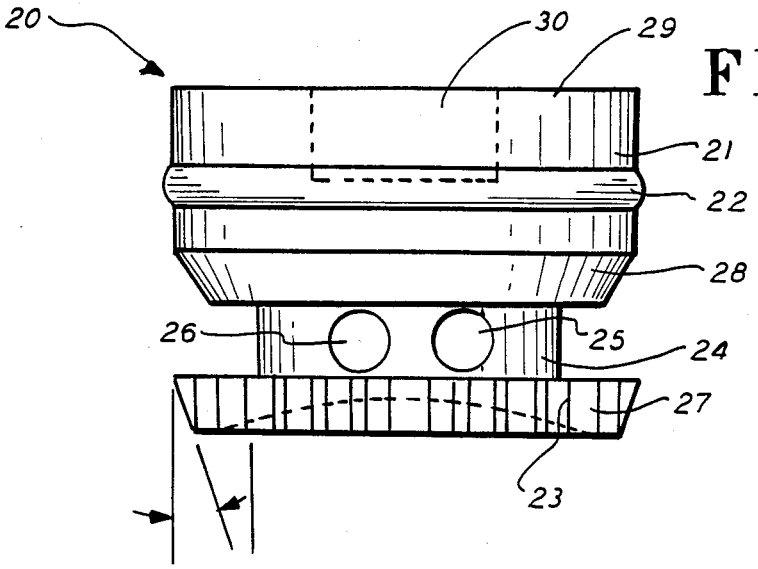
FIG. 5
FIG. 6
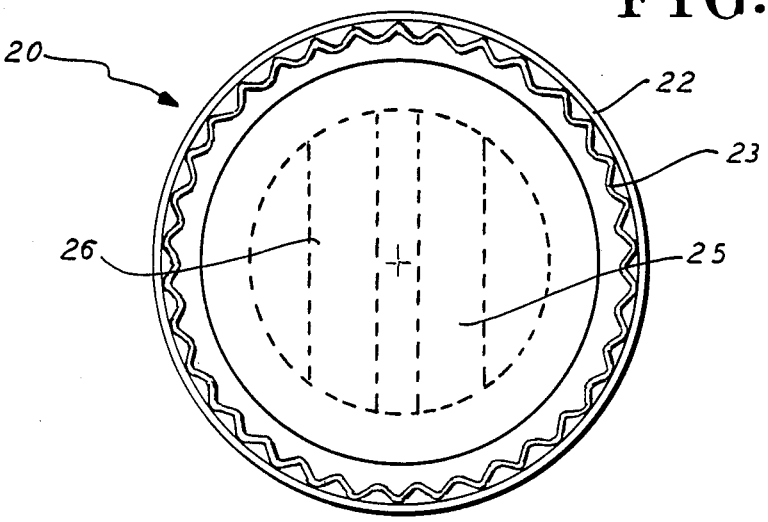

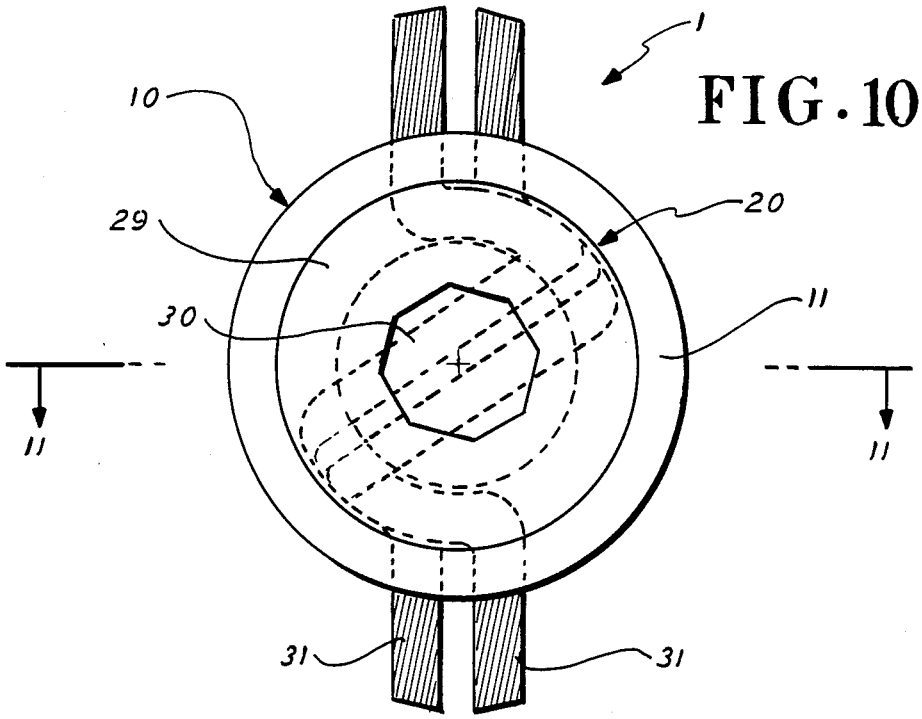
FIG. 10
FIG. 11
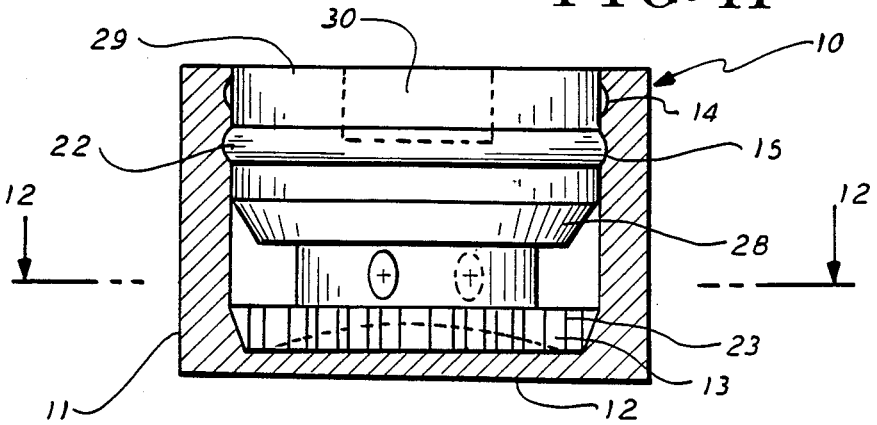
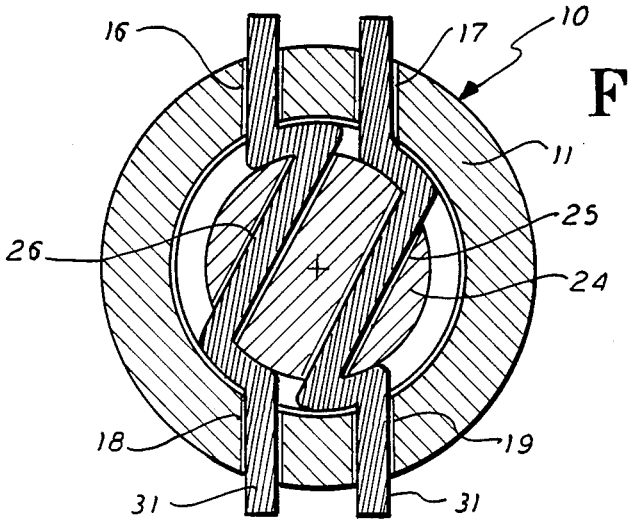
FIG. 12

ROTATABLE SEAL

This invention relates to a seal for securing containers, and, more particularly to a rotatable seal for locking a sealing wire to a hasp on a container. The container cannot be opened without destruction of the rotatable seal.

Various devices for sealing the hasps of containers such as railroad boxcars, trucks semi-trailers, barrels, and the like, have long been used as a means of assuring the security of the goods contained therein. Typical of such devices is a seal which comprises an elongated wire and a deformable metal seal, the wire being passed through the hasp and the ends thereof being crimped to the seal.

The present invention improves over the deformable metal seal. Specifically it relates to a seal which includes two inter-fitted, relatively rotatable members. A flexible sealing wire is passed through a hasp and then through aligned apertures in the members. Relative rotation is then imparted between the members to cause the wire to be deformed and to be locked between the members.

Various devices have been utilized in the prior art. Examples of such devices are found in U.S. Pat. No. 421,951 and in U.S. Pat. No. 1,911,060.

U.S. Pat. No. 421,951 issued Feb. 25, 1890, shows a rotatable seal lock wherein a strip seal is inserted within a rotatable member. Thereafter the member is rotated causing a dog to be received within an opening in the strip and pulled within the rotatable member to a retained position. The rotatable member is held against unlocking rotation by use a spring-loaded pawl.

U.S. Pat. No. 1,911,060 issued May. 23, 1933, discloses a sealing device having a body with apertures through which can extend a flexible sealing means. The center portion of the body is provided with a threaded bore which is in communication with the apertures. Disposed within the threaded bore is a uni-rotational screw which may be tightened down against the flexible securing means to retain it in a sealed position.

While the attributes of the foregoing seals are numerous, the need exists to provide a simple seal for securing a container wherein tampering can be observed and the seal structure is economical to construct.

It is an object of the invention, therefore, to provide a seal that is resistant to tampering.

It is a further object of the invention to provide a seal that provides an indication of any tampering action.

An additional object of the present invention is to provide a seal which is economical to manufacture and simple to use while at the same time being highly secure.

These objects and others not enumerated are achieved by the seal of the present invention, one embodiment of which may include two inter-fitted, relatively rotatable members, a flexible sealing wire is passed through aperatures in one of the members and then through the other member so that relative rotation imparted between the members causes the sealing wire to be deformed and thereafter axial movement between the members causes the wire to be locked between the members.

BRIEF DESCRIPTION OF THE DRAWINGS

A more complete understanding of the rotatable seal of the present invention may be had from the following detailed description thereof, particularly when read in the light of the accompanying drawings, wherein:

FIG. 4 is a plan view of the rotor member of the rotatable seal of the present invention;

FIG. 5 is a side view of the rotor member shown in FIG. 4;

FIG. 6 is a bottom view of the rotor member shown in FIG. 4;

FIG. 10 is a plan view of the rotatable seal of the present invention shown in sealing position;

FIG. 11 is a side view, partly in section, of the rotatable seal of FIG. 10;

FIG. 12 is a cross-sectional view through the plane 12—12 of FIG. 11 of the rotatable seal of the present invention;

A preferred embodiment of the rotatable seal of the present invention is best described in the context of FIGS. 1–12. The rotatable seal is generally indicated by the reference number 1, (FIG. 7), and includes a housing generally indicated as 10, a rotor generally indicated as 20, and a flexible sealing wire 31.

Figure 1:
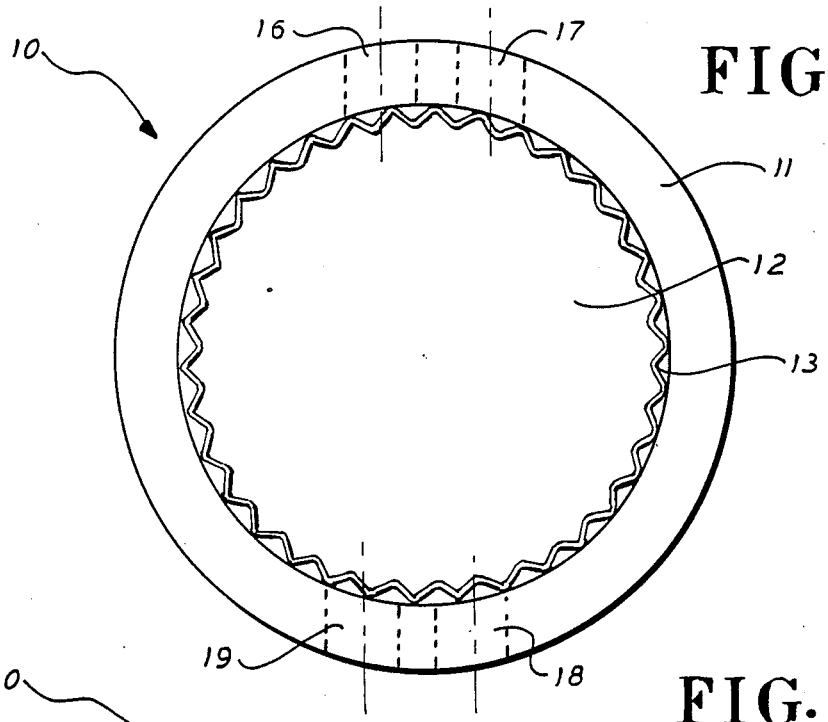
FIG. 1 is a plan view of the housing member of the rotatable seal of the present invention.
Figure 2:
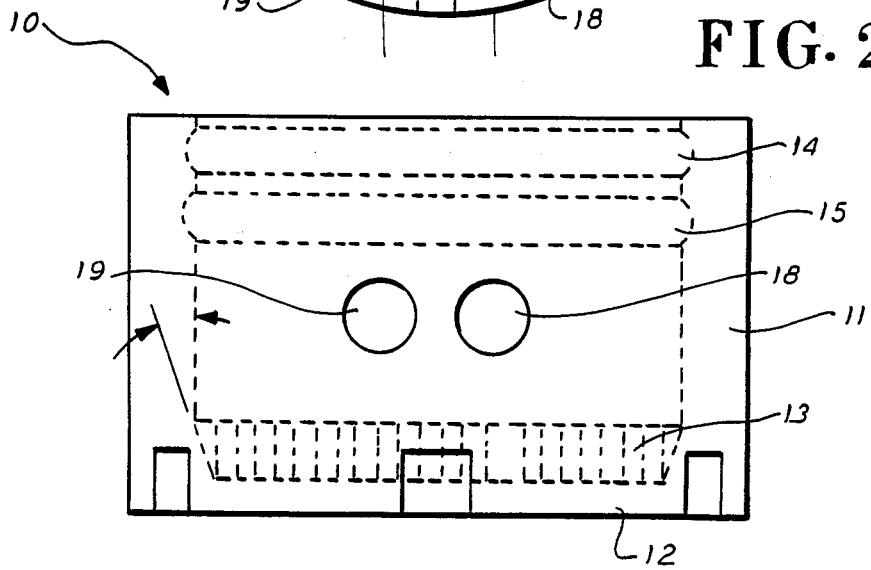
FIG. 2 is a side view of the housing member shown in FIG. 1.
Figure 3:
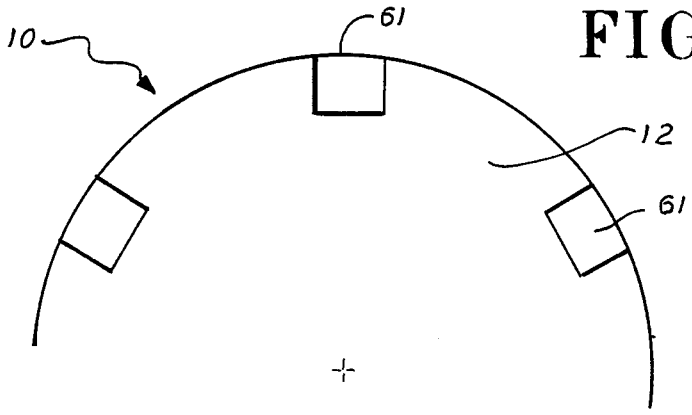
FIG. 3 is a partial bottom view of the housing member shown in FIG. 1.

Referring to FIGS. 1–3, housing 10 is a generally cylindrical member having a cylindrical wall 11 which is closed at one end by a base 12. Formed at the interior juncture of wall 11 and base 12 are a plurality of serrations or teeth 13 the inner surfaces of which are disposed at an acute angle of between 17°and 20°with respect to the inner surface of cylindrical wall 11.

Disposal adjacent the open end of housing 10 are a pair of axially displaced annular grooves 14 and 15. Located below grooves 14 and 15 but above serrations 13 as shown in FIG. 2 are a pair of chordally directed bores 16, 17, 18 and 19 formed in cylindrical wall 11. The axes of the bores 16, 17, 18 and 19 pass chordally of the center of rotation of wall 11. Further, bores 16 and 18 are coaxial as are bores 17 and 19 coaxial, the axes of the respective bores being parallel.

The rotor 20 is shown in detail in FIGS. 4–6. The rotor 20 has a generally cylindrical body 21. The body 21 has a top or head 29 having a centrally located tool opening 30 for use with a tool such as a snap-on octagonal tool. It is to be understood that the tool opening 30 can also have the configuration of a screw-driver tip slot, hexagonal snap-on tool opening, etc. On the outside surface of the body 21 near the head 29 is an external annular ridge 22. At the bottom of the body 21 is a flange 27 with tapered serrations or teeth 23. The serrations 23 have a downward taper of an angle of about 17°–20°. Immediately above the flange 27, is a reduced diameter channel portion 24 having two parallel bores 25, 26 extending therethrough. The bores 25 and 26 form parallel passages through the channel 24 which correspond in location to the bores 16 18 and 17, 19 of housing 10. Disposed immediately above channel 24 is a transition tapering section 28 which extends from channel 24 to the external surface on body 21.

Figure 7:
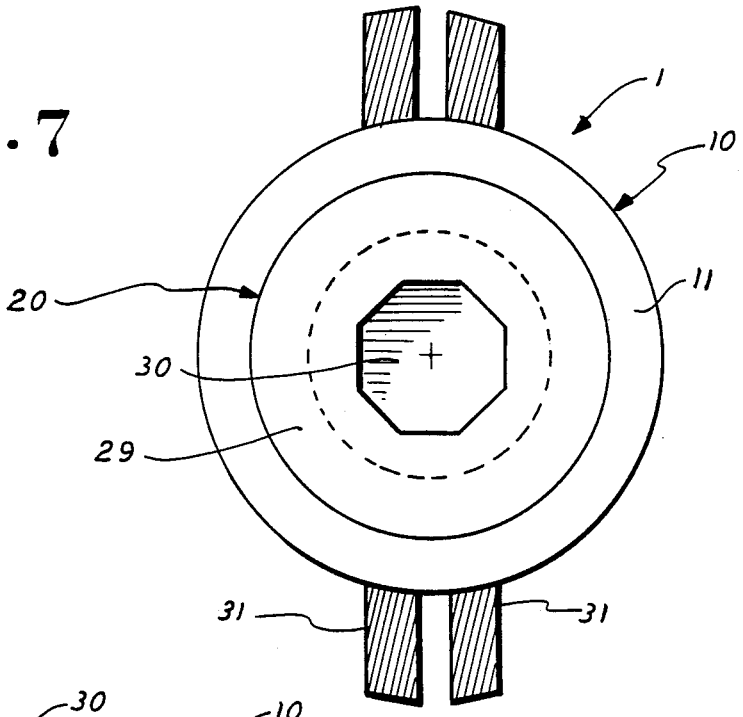
FIG. 7 is a plan view of the rotatable seal of the present invention with the seal wire inserted therethrough.
Figure 8:
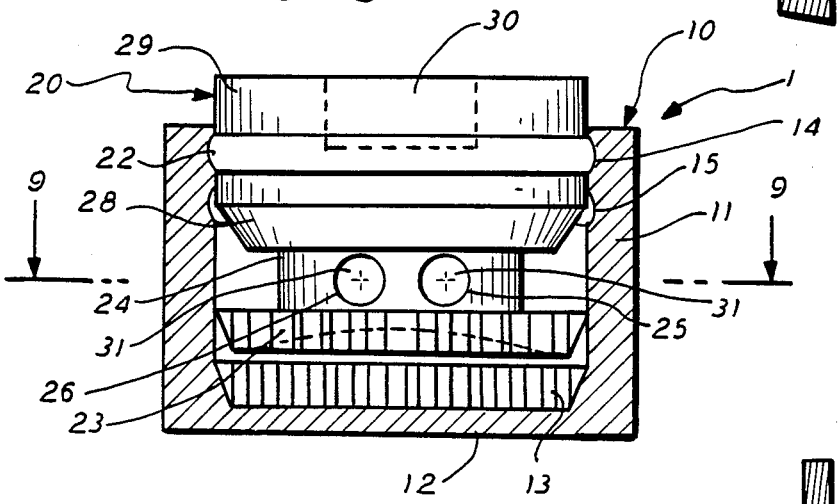
FIG. 8 is a side view, partly in section, of the rotatable seal of FIG. 7.
Figure 9:
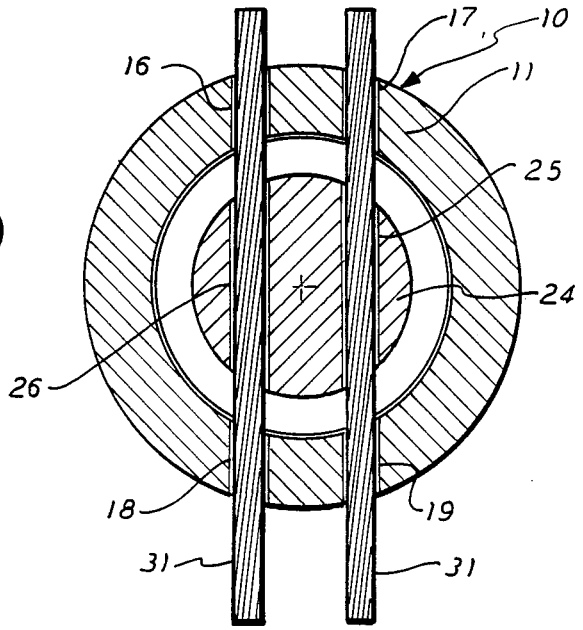
FIG. 9 is a cross-sectional view through the plane 9—9 of the rotatable of FIG. 8.

FIGS. 7–9 show the rotatable seal of the present invention in the opened position, i.e., with a sealing wire 31 extending therethrough but prior to sealing. Thus, the rotatable seal 1 consists of the rotor 20 interfitted within the housing 10. In the opened or unsealed position of the rotatable seal 1, the annular ridge 22 of the rotor 20 is in mating engagement with the first annular groove 14 of the housing 10. In this position, the housing apertures 16, 18 and 17, 19 of the housing 10 are aligned respectively with the rotor bores 25, 26 of the rotor 20 so as to form parallel passage-ways through the rotatable seal 1 for the sealing wire 31.

FIGS. 10–12 show the rotatable seal lock 1 of the present invention in the sealing position. As best may be seen in FIG. 10, the sealing wire 31 has been passed through the bores 16, 18 and 17, 19 of the housing 10 as well as through bores 25 and 26 of the rotor. The sealing wire in the bore 25 and 26 of the rotor 20 has been deformed by rotating rotor 20 causing apertures 31 to be rotated out of alignment with the apertures 16, 18 and 17, 19 of the housing 10. The rotor is rotated by the entrance of a tool (not shown) in the tool opening 30 to rotate the rotor 20 within the housing 10. At the same time or immediately subsequent to the time that the rotor 20 is rotated within the housing 10, the rotor 10 is also moved inwardly of housing 10 by the tool so that the annular ridge 22 is moved from annular groove 14 into mating engagement with the second annular groove 15 of the housing 10. Therefrom, the serrations 23 of the rotor 20 are moved into locking engagement with the serrations 13 of the housing 10. It can be seen when the rotatable seal 1 is in the closed or sealed position as shown in FIGS. 10—12, the sealing wire 31 is firmly locked within the rotatable seal 1. The locking is accomplished by the deformation of the sealing wire 31 together with the concurrent locking engagement of the teeth 13 and 23, and the frictional engagement of the ridge 22 with groove 15. When the sealing wire 31 has been deformed there is a resistance to any further rotation or reopening of the rotatable seal. The engagement of the teeth 23 and 13 also prevents rotation of the rotor 20 to an unlocking position.

It is a feature of the rotatable seal when in the locking position that the head 29 of the rotor 20 forms a smooth surface with the top of the cylindrical wall 11 of the housing 10. Such smooth surface makes it difficult for any tampering action to separate the rotor 20 from the housing 10 after closing of the rotatable seal 1 has been accomplished.

Figure 13:
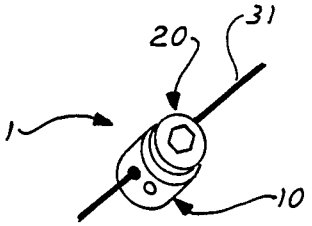
FIG. 13 is a perspective view of the rotatable seal of the present invention with the sealing wire in initial position.
Figure 14:
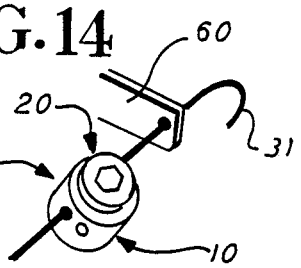
FIG. 14 is a perspective view of the rotatable seal of FIG. 13 with the sealing wire extending through the hasp.
Figure 15:
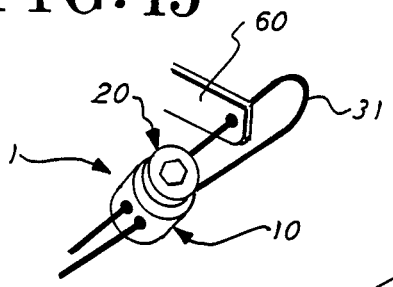
FIG. 15 is a perspective view of the rotatable seal of FIG. 13 with the sealing wire passing through the hasp and back through the other aperture of the rotatable seal.
Figure 16:
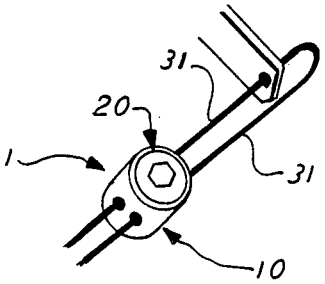
FIG. 16 is a perspective view of the seal of the present invention in closed, locking position.

FIGS. 13–16 show the operation of the rotatable seal 1 of the present invention. FIG. 13 shows the insertion of one end of the flexible wire 31 through the rotatable seal 1. FIG. 14 shows the wire inserted through the rotatable seal 1 and continuing through an opening in a hasp 60. FIG. 15 shows the wire 31 passing through the opened rotatable seal, passing through the opening in the hasp 60 and continuing back through the rotatable seal 1. FIG. 16 shows the rotatable seal 1 after it has been closed and locked in the sealing position. In this position it can be seen that the upper surface of rotor 20 is substantially co-planar with the upper rim of housing 10.

Figure 17:
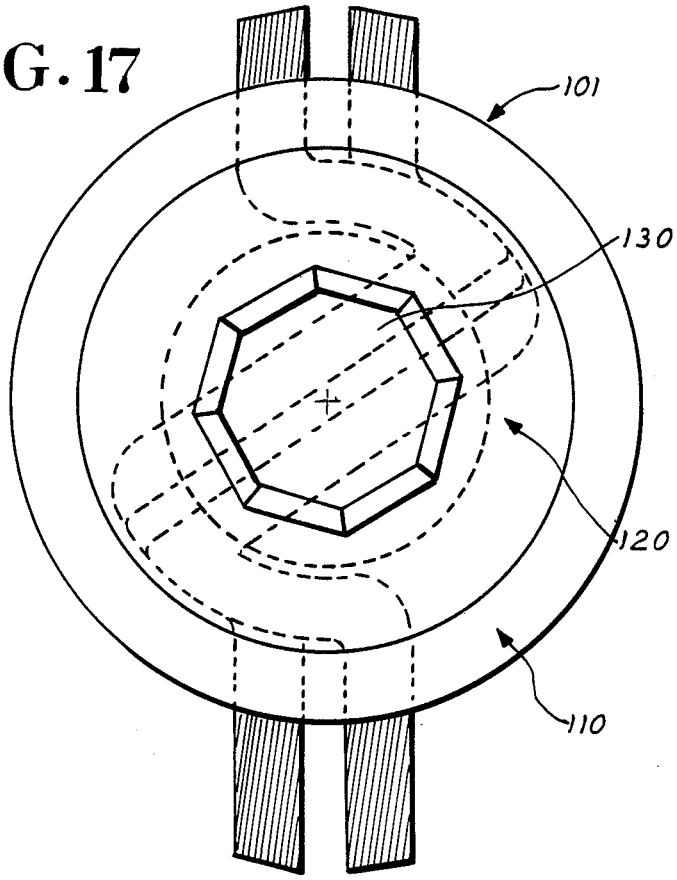
FIG. 17 is a plan view of the alternative embodiment of the rotatable seal of the present invention.
Figure 18:
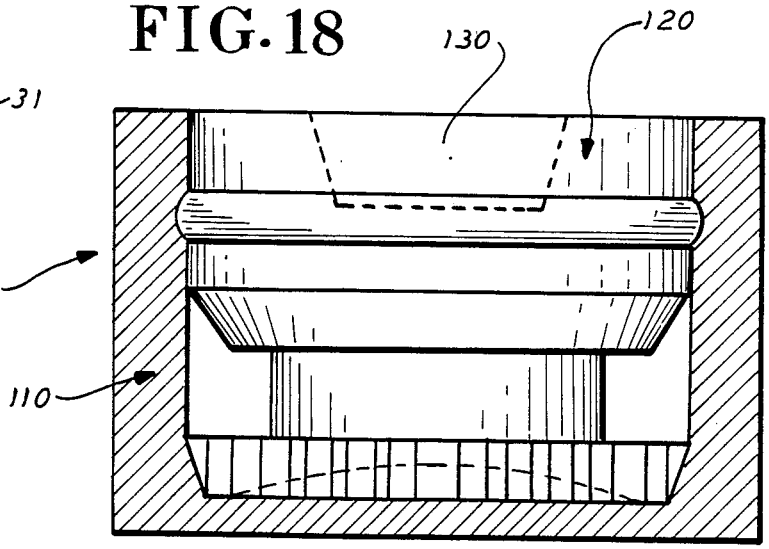
FIG. 18 is a side view partially in section of the alternative embodiment of the rotatable seal.

An alternative embodiment of the rotatable seal of the present invention is shown in FIGS. 17 and 18, and designated generally by reference numeral 101. The rotatable seal 101 has a rotor 120 with an upward tapering tool opening 130 therein. More specifically, the tool opening 130 of rotor 120 is provided with a typical octagonal bore to accomodate a suitable tool for impacting rotation. However, the octagon-defining surfaces are angled upwardly-outwardly as shown in FIG. 18 to provide a tapered tool opening. The resulting outward taper makes it uniquely difficult for anyone attempting to tamper with the seal to lift the rotor 120 out of housing 110, for example by using an expanding tool in the opening 130.

Figure 19:
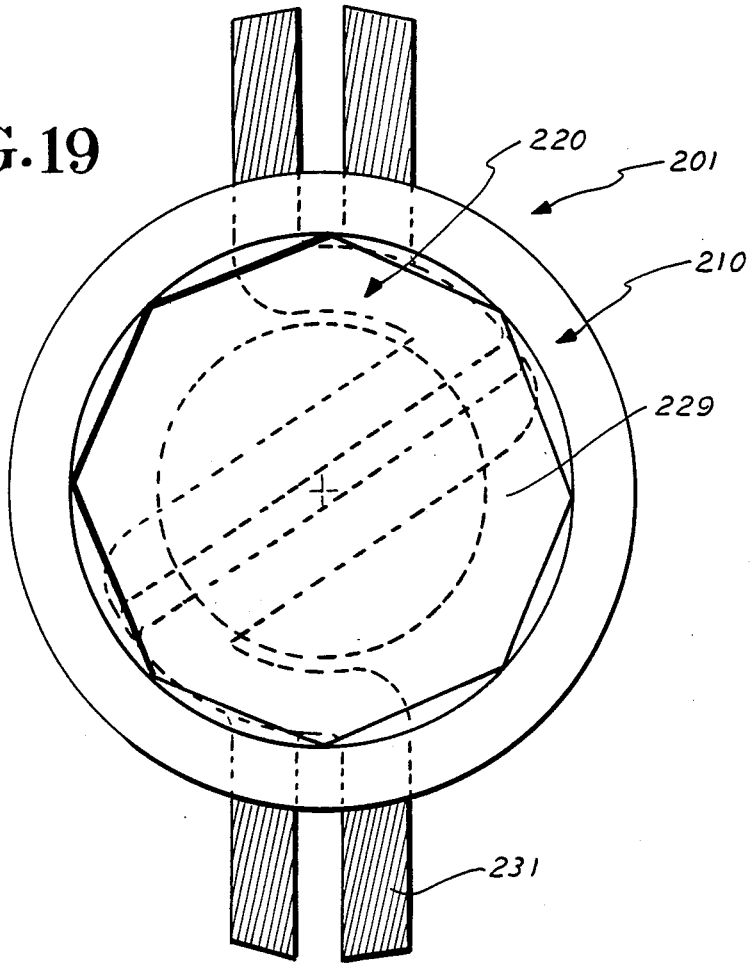
FIG. 19 is a plan view of a further embodiment of the rotatable seal of the present invention.
Figure 20:
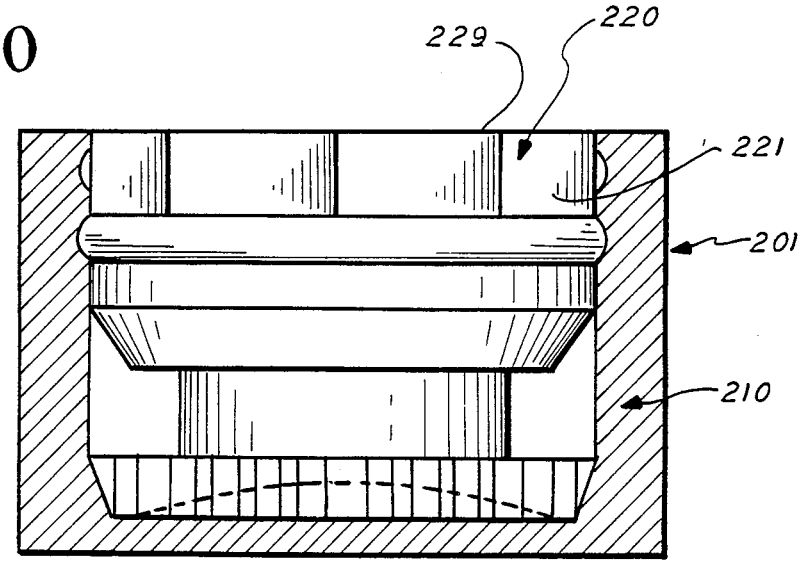
FIG. 20 is a side view partially in section of the embodiment of the rotatable seal of the present invention shown in FIG. 19.

A further embodiment of a rotatable seal according to the present invention is shown in FIGS. 19 and 20 and designated generally by reference numeral 201. The rotatable seal 201 is comprised of a housing 210 with an inner-fitting rotor 220 therein. The upper portion 221 of the body of the rotor 220 has the peripheral configuration of an octagon, the apexes of which are in surface-to-surface sliding contact with the cylindrical inner surface of the housing 210. Thus, when the elements of the seal 201 are in unlocked position (not shown), a tool may be placed on the octagonal portion 221 of the motor 220 so as to rotate the rotor causing the seal wire 231 (FIG. 19) to be drawn within the seal and to wrap at least partially around the rotor. Thereafter the rotor is advanced into housing 210 into the locked position (FIG. 20). When in the locked position, all of the octagonal portion 221 is disposed within housing 210 thus making it substantially impossible for anyone attempting to tamper with the seal to be able to get a grip on the octagonal surface of the rotor such as to displace the rotor out of the housing. Any attempt to so tamper with the seal is likely to leave evidence of the tampering.

The housing and rotor of the rotatable seal of the present invention may be made from strong and essentially semi-rigid materials such as metal, rubber, plastics, etc. A preferred material is acrylic plastic. The housing and rotor of the rotatable seal of the present invention may also be made from clear materials so that the positive locking of the seal wire can be inspected and can also provide a visual indication of tampering.

The flexible sealing wire used with the rotatable seal of the present invention may be in the form of wire, or rope, or cable, etc.; made of metal or plastic or other suitable materials.

When in the locked position, the inter-fitting members of the present invention must be destroyed, or the sealing wire must be cut, in order to remove the seal from the hasp. Due to the strong materials of construction, substantial effort is required either to destroy the members or to cut the wire. Also, such destruction or cutting provides an immmediate indication of tampering.

While the present invention has been described with a degree of particularity, it should be understood that variations and modifications will be obvious to those skilled in the art without departing from the scope of the present invention as defined in the appended claims.

What is claimed is:

1. A seal comprising:

a housing, said housing having an opening therein defined by an outer wall;

a plurality of bores formed in said outer wall of said housing for receiving a seal wire therethrough;

a rotor rotatably disposed within said opening;

at least one bore formed in said rotor, said bore in said rotor being suitable for receiving said seal wire therethrough;

first retaining means for retaining said rotor partially within said housing in a position wherein said plurality of bores in said housing are co-planar with said at least one bore formed in said rotor; and second retaining means for retaining said rotor totally within said housing.

2. A sealing according to claim 1 wherein said plurality of bores in said housing comprises two pairs of bores, each pair being coaxial, and wherein said rotor has two bores formed therethrough, said two bores being disposed to have one bore coaxial with one of said pairs of bores in said housing and the other bore coaxial with the other of said bores in said housing when said rotor is retained partially within said housing and rotated to so align said two bores.

3. A seal according to claim 1 wherein said rotor is rotatable within said housing when retained partially within said housing, and further including means for precluding rotation of said rotor within said housing when said rotor is retained totally within said housing.

4. A seal according to claim 1 wherein said first retaining means comprises an annular ridge formed on the surface of said rotor and a first annular channel formed in the inner surface of said housing, wherein receipt of said annular ridge within said first annular channel rotatably retains said rotor partially within said housing.

5. A seal according to claim 4 wherein said second retaining means includes a second annular channel formed in the inner surface of said housing, wherein receipt of said annular ridge within said second annular channel retains said rotor totally within said housing.

6. A seal according to claim 3 wherein said means for precluding rotation of said rotor within said housing comprises serrations formed in the said rotor and within said housing, said serrations being interengageable when said rotor is totally received within said housing, and wherein the interengagement of said serrations precludes rotation of said rotor within said housing.

7. A seal according to claim 1 including tool receiving means disposed in said rotor for receiving a tool for rotating said rotor within said housing.

8. A seal according to claim 7 wherein said tool receiving means comprises a non-circular opening formed in said rotor, said non-circular opening having a flared tool-engaging surface such as to reduce the ability of the opening to be used to displace the rotor outwardly of the housing.

9. A seal according to claim 7 wherein said tool receiving means comprises a non-circular surface defined by a portion of the outer surface of said rotor, said non-circular surface being in surface-to-surface contact with the inner surface of said housing at least two points when said rotor is retained totally within said housing such as to reduce the ability of the surface to be used to displace the rotor outwardly of the housing.

* * * * *